US005354640A

United States Patent [19]

Kanbayashi et al.

[11] Patent Number: 5,354,640

[45] Date of Patent: Oct. 11, 1994

[54] TONER FOR DEVELOPING ELECTROSTATIC IMAGE

[75] Inventors: Makoto Kanbayashi, Kawasaki; Takayuki Nagatsuka, Yokohama; Takashige Kasuya, Soka; Tatsuya Nakamura; Tatsuhiko Chiba, both of Tokyo, all of Japan

[73] Assignee: Canon Kabushiki Kaisha, Tokyo, Japan

[21] Appl. No.: 948,251

[22] Filed: Sep. 21, 1992

[30] Foreign Application Priority Data

Sep. 25, 1991 [JP] Japan ..... 3-271863

[51] Int. Cl.[5] ..... G03G 9/00

[52] U.S. Cl. ..... 430/110; 430/137; 430/138; 428/402.24

[58] Field of Search ..... 430/110, 137, 138, 111; 428/402.24

[56] References Cited

U.S. PATENT DOCUMENTS

| | | | |
|---|---|---|---|
| 2,297,691 | 10/1942 | Carlson | 95/5 |
| 3,634,251 | 1/1972 | Maeda et al. | 252/62.1 |
| 3,959,153 | 5/1976 | Sadamatsu et al. | 252/62.1 P |
| 4,971,879 | 11/1990 | Kimura et al. | 430/106.6 |
| 5,130,219 | 7/1992 | Mori et al. | 430/106 |
| 5,130,220 | 7/1992 | Nakamura et al. | 430/109 |
| 5,135,833 | 8/1992 | Matsunaga et al. | 430/110 |
| 5,143,812 | 9/1992 | Mori et al. | 430/124 |
| 5,153,092 | 10/1992 | Kao et al. | 430/110 |

FOREIGN PATENT DOCUMENTS

| | | |
|---|---|---|
| 36-10231 | 7/1961 | Japan . |
| 47-51830 | 12/1972 | Japan . |
| 51-14895 | 5/1976 | Japan . |
| 53-17735 | 2/1978 | Japan . |
| 53-17736 | 2/1978 | Japan . |
| 53-17737 | 2/1978 | Japan . |
| 153786 | 11/1989 | Japan . |

*Primary Examiner*—Steve Rosasco

*Attorney, Agent, or Firm*—Fitzpatrick, Cella, Harper & Scinto

[57] ABSTRACT

A toner for developing an electrostatic image has toner particles. The toner particles are prepared by suspension polymerization and contain at least two components comprised of a high softening point resin-A and a low softening point material-B. The toner particles each have a structure separated into a phase-A mainly composed of the resin-A and a phase-B mainly composed of the material-B. The phase-B is absent in the vicinity of the toner particle surface, ranging from its surface to a depth 0.15 time a toner particle diameter. The toner particles contain an organic solvent, a polymerizable monomer or a mixture thereof in a quantity of not more than 1,000 ppm.

32 Claims, 2 Drawing Sheets

TONER FOR DEVELOPING ELECTROSTATIC IMAGE

BACKGROUND OF THE INVENTION

1. Field of the Invention

The present invention relates to a toner for developing an electrostatic image, which is used to develop an electrostatic image, followed by heat fixing, in an image forming process such as electrophotography.

2. Related Background Art

There is an image forming method in which an electrical or magnetic latent image on a recording member is converted to a visible image by attracting to the latent image, electroconductive or magnetosensitive fine particles called a toner.

In electrophotography, which is a typical example thereof, a large number of methods have been conventionally known, as disclosed, for example, in U.S. Pat. No. 2,297,691. In general, in such electrophotography method, an electrostatic latent image is formed on a photosensitive member, utilizing a photoconductive material and according to various means, and subsequently the latent image is developed using a toner to form a toner image. Then the toner image is transferred to a transfer medium such as paper if necessary, and the toner image is fixed to the transfer medium by the action of heat, pressure and/or solvent vapor. A copy is thus obtained. At present, a fixing method that utilizes heat is prevaling in view of its advantages in fixing strength of copies, readiness to handle transferred objects and ease in operation. Such a fixing method includes a method that utilizes radiation heat as in the heat chamber system, and also what is called heat roller fixing system in which a heated roll type heating member is pressed against a toner image to fix the image. The latter system is employed in most machines in view of its high heat efficiency, high-speed adaptability and high-safety. However, in spite of the high heat efficiency, the energy used in heat melting occupies a reasonably large proportion in a copying machine. In addition, there is a disadvantage that it is difficult to avoid what is called the offset phenomenon wherein the toner adheres to a heat roll because of direct contact with a molten toner image to soil subsequent images and in an extreme case what is called the wind-around phenomenon in which the whole medium to which the toner image is fixed is wound around a heat roll. In order to decrease the energy required for the melting of toner, it can be greatly effective to increase the quantity of components capable of melting at a low temperature, and in order to lessen the adhesion of toner to a heat roller, to incorporate in the toner a wax or oil that does not melt together with a binder resin of the toner and becomes fluid faster than, and has a smaller cohesive energy than, the binder resin of the toner. Such materials, however, are disadvantageous in that they may at the same time decrease the fluidity of toner and very much lower the developing performance.

Toners used for such purpose have been hitherto usually obtained by mixing and melting in a thermoplastic resin a coloring material comprised of a dye and/or a pigment and a magnetic material and uniformly dispersing the coloring material, followed by pulverization and classification to produce a toner having the desired particle diameter. This method is relatively stable as a technique and can enjoy relatively easy control of the materials and process. However, because of exposure of contents to rupture cross-sections, it has been impossible for the aforesaid component for giving a low melting point and component for Giving release properties to be incorporated in quantities large enough to be effective. Besides, this method has a poor energy efficiency since the materials are once melted together with a binder resin so that they are mixed and made stationary, and further the molten product is cooled, followed by mechanical pulverization. Moreover, the toner tends to have a broad particle size since its particles are finely divided by mechanical pulverization, so that the toner must be managed in the subsequent step of classification to have the desired particle size distribution. This may bring about a difficulty that the products can not be obtained in a higher yield. In order to solve such problems, a process in which the toner is produced by what is called suspension polymerization is proposed as a new production process.

For example, Japanese Patent Publications No. 36-10231, No. 47-51830 and No. 51-14895 and Japanese Patent Applications Laid-open No. 53-17735, No. 53-17736 and No. 53-17737 disclose a process for producing a toner by the suspension polymerization. In the suspension polymerization, materials that are required to be contained in a toner as exemplified by a binder resin, a colorant such as a dye or a pigment, a magnetic material, carbon black, a charge control agent and a release agent such as wax or silicone oil are uniformly dissolved or dispersed in polymerizable monomers optionally together with a polymerization initiator and a dispersant to form a polymerizable composition, and this polymerizable composition is put in an aqueous continuous phase containing a dispersion stabilizer to form fine particles by the use of a dispersion machine, followed by polymerization reaction to effect solidification so that toner particles with the desired particle diameters can be obtained in one step when the polymerization is completed.

This suspension polymerization, which requires no pulverization step, may make it possible to omit not only the melting step and pulverization step but also the subsequent classification step, and can be greatly effective for cost reduction such as energy saving, time shortening and improvement in process yield.

The present inventors have hitherto developed a polymerization toner in which silicone oil, a wax or a low-molecular weight component with a molecular weight of not more than 3,000 has been incorporated in a large quantity, which otherwise can not be produced or stored if produced by the usual method relying on kneading and pulverization. This polymerization toner is produced utilizing the properties that polar components are localized in the vicinity of particle surfaces and non-polar components are concentrated to the centers when suspension polymerization is carried out in an aqueous medium. Thus, a toner capable of being fixed at a low temperature and requiring no application of a release agent to a fixing assembly during fixing has been obtained.

In the suspension polymerization, in the case of styrene-acrylic vinyl type polymerizable monomers, a toner composition that can be used as a heat-fixing toner on the whole can be obtained when a polymerization initiator is used in an amount of from 0.5% to 20% by weight and the polymerization temperature is so set that the half-life period of the polymerization initiator is controlled to be from 0.5 hour to 30 hours.

Even when the polymerization conversion is at least 90% under such conditions, toner particles tend not to coalesce into a rice cake, when stirring was stopped. For example, at the moment when the polymerization conversion has reached 97 to 98%, toner particles may be taken out and dried, so that they can be used as a toner without any particular problems.

However, in the case when a low-temperature melting wax is contained in this polymerization toner system in a large quantity, though images with a good-quality can be obtained without any problem in a normal environment, a lowering of blocking resistance and a lowering of developing performance have occurred after the toner has been left in an environment of a high temperature.

U.S. Pat. No. 4,971,879 discloses a toner resin obtained by suspension polymerization, having therein not more than 200 ppm of remaining monomers.

This U.S. Pat. No. 4,971,879 discloses decreasing the quantity of monomers remaining in a toner resin (a resin used for a toner), which is fundamentally different from the technique concerning the decreasing of remaining monomers in the toner obtained by suspension polymerization, containing the above wax in a large quantity.

Besides, taking note of the shape of toner particles obtained by suspension polymerization, they are truly spherical. Such a shape has been hitherto deemed to be suitable for achieving a high image quality. A toner with spherical particles, however, tends to cause a deterioration of its performance when various external additives are used, and can not be a toner having an excellent running performance. The toner with spherical particles also has so strong an adhesion to a photosensitive member that it tends to cause an image deterioration accompanied tends faulty transfer and also can cause faulty cleaning after the transfer step. Such difficulties have been confirmed.

SUMMARY OF THE INVENTION

An object of the present invention is to provide a toner for developing an electrostatic image, that has solved the problems as discussed above.

Another object of the present invention is to provide a toner for developing an electrostatic image, that has a superior blocking resistance even in an environment of high temperature and high humidity Still another object of the present invention is to provide a toner for developing an electrostatic image, that can be fixed at a low temperature, has superior release properties and stably shows a high developing performance.

A further object of the present invention is to provide a toner for developing an electrostatic image, that can achieve a high image density.

A still further object of the present invention is to provide a toner for developing an electrostatic image, that may undergo less changes in performances in its long-term use.

To achieve the above objects, the present invention provides a toner for developing an electrostatic image, comprising toner particles;

said toner particles comprising;

being prepared by suspension polymerization;

containing at least two components comprised of a high softening point resin-A and a low softening point material-B;

each having a structure separated into a phase-A mainly composed of said resin-A and a phase-B mainly composed of said material-B, said phase-B being absent in the vicinity of the toner particle surface, ranging from its surface to a depth 0.15 time a toner particle diameter; and containing an organic solvent, a polymerizable monomer or a mixture thereof in a quantity of not more than 1,000 ppm.

DESCRIPTION OF THE PREFERRED EMBODIMENTS

Figure 1:
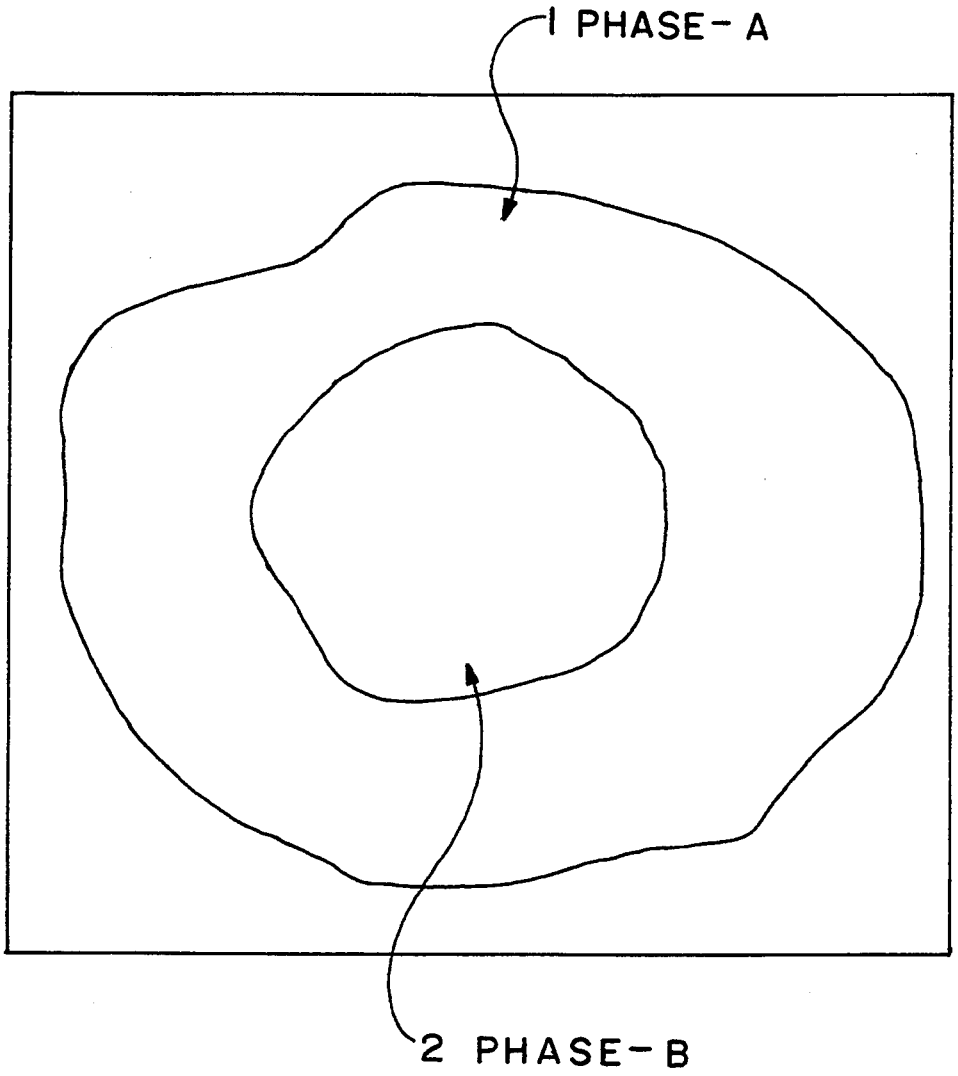
FIG. 1 is a cross section to illustrate a state in which a particle of the toner according to the present invention is separated into two phases.

As shown in FIG. 1, the particle of the toner according to the present invention has a surface layer portion 1 (phase-A) and a central portion 2 (phase-B) and is separated into two phases with a distinct boundary between them. A capsular structure is thus given to each particle, which functionally separates the particle into the surface layer portion and the central portion, and enables preferable toner designing that has been impossible in conventional toners. Stated specifically, a high softening point resin is used in the surface layer so that the toner can have a blocking resistance or a strong resistance to its vigorous motion in a developing assembly, and a low softening point material is used in the central portion or core so that the toner can have a superior fixing performance at the same time. In addition, a release material with a low melting point may have been incorporated in the core, which may be forced to exude therefrom by the application of pressure during fixing, so that the anti-offset properties can be remarkably improved. Moreover, charge control properties may be imparted only to the surface layer.

The particle in the present invention has a more definite surface layer than quasi-capsules disclosed in Japanese Patent Publication No. 1-53786, etc., and therefore the inside materials do not easily exude to the surface layer so long as no heat or pressure is applied. Hence, a remarkable improvement is brought about also in preventing the phenomenon that the inside low softening point material soils a carrier or a developing sleeve. In particular, this can be superior to the quasi-capsules when the low softening point material is contained in a large quantity.

In the toner of the present invention, the low softening point material-B such as a low-molecular weight component in a polymer and a non-polar component is made to be internally held at the core of the toner particle by suspension polymerization. However, when toners are produced by suspension polymerization, the viscosity of the polymerizable monomer system increases as the polymerization reaction proceeds, so that it becomes difficult for radicals and polymerizable monomers to move and hence unreacted polymerizable monomers tend to remain in the polymer. In the case of toners produced by conventional pulverization, it is possible to drive off remaining polymerizable monomers by applying heat during the preparation of the resin for toner or during the melt kneading. On the other hand, in the case of the toner produced by the suspension polymerization that can directly produce the toner, the system may not be heated at so a high temperature, so that polymerizable monomers may remain integrally within toner particles in a larger quantity than in the case of the conventional pulverization toners. Here, if the toner produced by suspension polymerization is left to stand at a high temperature in the absence of water, it is presumed that the low softening point materials such as a low-molecular weight component and a non-polar component present at the core are transported toward the surface to remain there when the unreacted polymerizable monomers gradually volatize from the surface, resulting in a deterioration of the developing performance of the toner. In the toner, a volatile organic solvent is also present in a very small quantity besides the polymerizable monomers. Including these components, the content of the whole solvent components is controlled to be not more than 1,000 ppm when the suspension polymerization toner is produced. It is thereby possible to obtain a toner that can be free from deterioration to cause no blocking even when left in an environment of high temperature while the low softening point materials remain internally held in a large quantity.

The toner of the present invention may preferably have an uneven particle surface. FIG. 2 shows an example of the surface configuration. It has been made clear that toner particles having such uneven surfaces have smaller contact points between the toner particles to bring about an improvement in blocking resistance and also an improvement in long-term stability of the blocking resistance. In general, the addition of a fluidity-providing agent to a toner brings about an improvement in blocking resistance because of the fluidity-providing agent serving as a spacer. However, when various additives such as the fluidity-providing agent are used in spherical toners produced by usual suspension polymerization, the additives may fix on toner particle surfaces because of the stress produced by stirring or the like to cause an inhibition of the functions of the additives. On the other hand, when the toner particles have uneven surfaces, it is presumed that the uneven surfaces of the toner particles prevent the additives from being deteriorated and hence a Good blocking resistance can be maintained for a long period of time. The uneveness of the toner particle surfaces can also contribute an improvement in cleaning performance.

Since the toner produced by suspension polymerization according to the present invention is comprised of substantially spherical particles, images with a high quality can be obtained. Since also any fine pulverization does not tend to occur as a result of agitation in a developing assembly, no fogging or black spots around images caused by fine powder can occur.

In the present invention, the toner particle contains at least the two components, high softening point resin-A and low softening point material-B, preferably in a proportion A:B of from 50:50 to 95:5, and has a structure separated into a phase mainly composed of component-A and a phase mainly composed of component-B. The phase mainly composed of component-A forms the surface layer and the phase mainly composed of component-B is present at the core.

The resin-A may preferably have a weight average molecular weight ranging from 5,000 to 200,000 in the molecular weight distribution measured by GPC (gel permeation chromatography), and may preferably have a flow-out point (a point at which the resin begins to flow out) of from 65° to 100° C. when measured with a flow tester. As the resin-A, any resins can be used so long as they are obtained by suspension polymerization, which may have a functional group that can serve as a charge site and a functional group that can improve adhesion to a recording medium such as paper.

Polymerizable monomers that can be used in the suspension polymerization described above may include styrene monomers such as styrene, o-methylstyrene, m-methylstyrene, p-methylstyrene, p-methoxystyrene and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylehexyl acrylate, stearyl acrylate, 2-chloroethyl acrylate and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylonitrile monomers; methacrylonitrile monomers; and acrylamide monomers.

Any of these monomers may be used alone or in combination. Of the above monomers, it is preferable from the viewpoint of developing performance and durability of the toner to use styrene monomers alone or in combination with other monomer(s).

The component-B used in the present invention may preferably have a weight average molecular weight Mw ranging from 300 to 10,000 in the molecular weight distribution measured by GPC, and may preferably have a melting point of from 30° to 130° C., and more preferably from 60° to 100° C. In the case when the component-B has a melting point below 30° C., low-temperature offset may be promoted during fixing to provide a bad result. In the case when the component-B has a melting point above 130° C., the component-B may be solidified during the preparation of the toner to bring about a poor granulation performance.

The present invention can be more effective when a wax is used as the component-B. The wax used in the present invention may include paraffin waxes, polyolefin waxes, oxides thereof or modified products such as grafted products thereof, higher fatty acids and metal salts thereof, and amide waxes.

The resin-A and the component-B may preferably in a component ratio A:B of from 50:50 to 95:5 as previously stated, and more preferably A:B of from 70:30 to 90:10. In the case when the component-B is more than A:B=50:50, no capsular structure may be retained, and in the case when the component-B is less than A:B=95:5, the component-B can not well effectively operate.

In the present invention, the phase mainly composed of the component-B is absent from the vicinity of the toner particle surface, ranging from its surface to a depth 0.15 time a toner particle diameter. Stated conceptionally, this means that the surface layer has a thickness 0.15 time the toner particle diameter. For example, even a configuration in which cracks are present and some part of the surface layer has not the thickness 0.15 time the toner particle is included in the scope of the present invention so long as the phase mainly composed of component-B is absent in the cracks. If the phase mainly composed of component-B is present in the vicinity of the toner particle surface, ranging from its surface to et depth 0.15 time a toner particle diameter, the capsular structure may become unstable to tend to result in, for example, a poor blocking resistance.

In the present invention, to confirm whether the phase-B mainly composed of the component-B is present in the vicinity of the toner particle surface, ranging from its surface to a depth 0.15 time a toner particle diameter, cross sections of toner particles are observed using a transmission electron microscope according to the dyed ultra-thin sections method.

As previously stated, the toner particles in the present invention may preferably be substantially spherical. More preferably, with respect to a projected area of the toner particle, its maximum inscribed circle corresponding to its radius r and minimum circumscribed circle corresponding to its radius R satisfy the expression:

$$1.00 < R/r \leqq 1.20.$$

With an increase in the value of R/r, the particle tends to become less spherical. When the value of R/r is more than 1.20 there is no characteristic feature for a spherical toner. Such spherical toner particles may preferably have a weight average particle diameter of from 2 to 20 μm, more preferably from 3 to 12 μm, and still more preferably from 4 to 10 μm.

In the present invention, circumferential length L and circumference l of the inscribed circle of a projected area of the toner particle may preferably satisfy the relationship of:

$$1.01 < L/l < 2.00.$$

A toner particle with circumferential length L smaller than 1.01×1 results in a particle having little unevenness. On the other hand, a toner particle with a value larger than 2.00×1 has a large number of minute or fine concavities, or has concavities with great differences in depth. In the case where the toner particle has a circumferential length L smaller than 1.01×1, the concavities are too fine to readily give the operational effect. In the case where the toner particle has a circumferential length L larger than 2.00×1, the particle becomes approximate to a substantially amorphous particle, making it difficult to obtain a high image quality and also tending to bring toner particles into a finely powdered state in a developing assembly.

Figure 2A:
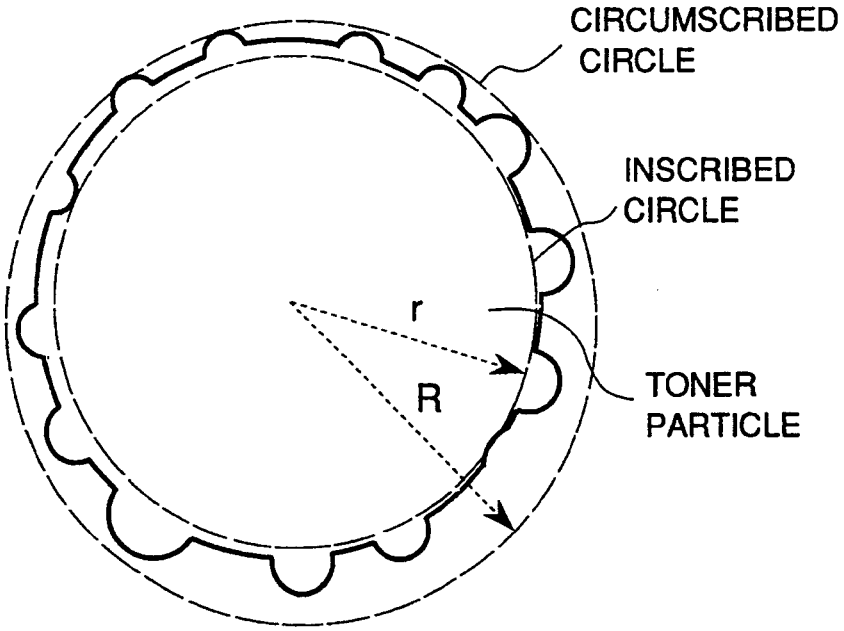
FIGS. 2A and 2B are views to illustrate conditions for the external form of a particle of the toner according to the present invention.
Figure 2B:
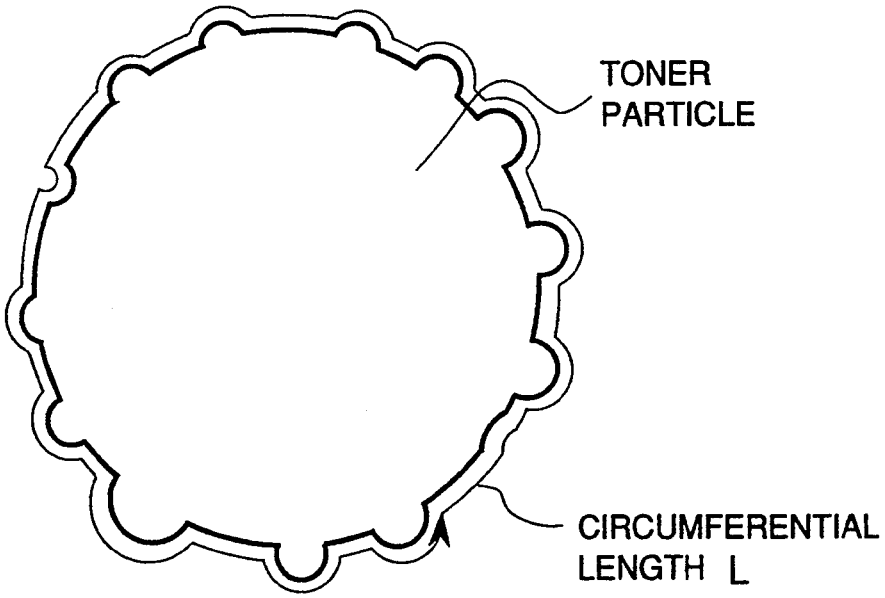

The projected area of the toner particle in the present invention refers to an image obtained by focusing the lens of an electron microscope on the contour of a toner particle at magnification of at least 2,000, and preferably 5,000. Using Roozex 5000, the radius r of its inscribed circle and the radius R of its circumscribed circle are also determined as shown in FIG. 2A. The circumferential length L is also determined as shown in FIG. 2B.

These R, r and L are measured on at least 50, and preferably 100 or more, toner particle images. Average values thereof may preferably satisfy the relationships set out above.

The particle surfaces can be made uneven or concave as described above, by dissolving in monomers a polar resin soluble in the monomers that form the resin-A mainly composing the surface layer, and thereafter taking the steps of conventional granulation and polymerization.

The polar resin usable in the present invention may include; (1) cationic polymers as exemplified by polymers of nitrogen-containing monomers such as dimethylaminoethyl methacrylate and diethylaminoethyl methacrylate, or copolymers thereof with styrene or an unsaturated carboxylic acid ester, and (2) anionic polymers as exemplified by polymers of nitrile monomers such as acrylonitrile, halogen type monomers such as vinyl chloride, unsaturated carboxylic acid monomers such as acrylic acid and methacrylic acid, unsaturated dibasic acid monomers, unsaturated dibasic acid anhydride monomers or nitro monomers, or copolymers thereof with styrene monomers. Examples are by no means limited to these.

Of these polar resins, it is particularly preferable to use those having a ratio of weight average molecular weight to number average molecular weight (Mw/Mn), as measured by GPC, of preferably from 1.2 to 10, and more preferably from 1.5 to 5. Granulation and suspension polymerization carried out by adding such a polar resin to monomers promote the phase separation into the phase mainly composed of resin-A (phase-A) and the phase mainly composed of component-B (phase-B). In other words, the boundary between phase-A and phase-B becomes distinct, and the concentration of the component-B contained in the phase-A becomes extremely low. As a result, the capsular structure of the toner particle itself becomes more remarkable, making it more possible to achieve both the improvement in blocking resistance and the improvement ill fixing performance.

Such a tendency is more remarkable as the polar resin has a higher acid value, and the phase separation is promoted when its acid value is not less than 5 mg KOH/g, and preferably not less than 20 mg KOH/g. Moreover, the polar resin with a high acid value tends to be localized in the vicinity of the toner particle surface in the phase-A, so that this resin greatly affects the configuration of the particle surface, making it possible to produce the toner particles having uneven surfaces in the form that their surfaces are concave. Although details are unclear, it is presumed as follows: The polar resin with a high acid value is concentrated in the vicinity of the toner particle surface in the step of granulation and at the initial stage of the suspension polymerization, and, as the reaction of polymerization of monomers proceeds, is present in the vicinity of the surface as a sort of an aggregate in which molecules of the polar resin have gathered. After a while, once the volume shrinkage of suspended particles begins to take place as a result of the polymerization of monomers, the degree of shrinkage becomes different depending on the manner in which the polar resin is localized, and soon after the shaped toner particles in the form where their surfaces are each concave are produced. Such an effect can be less obtained when a polar resin with an acid value less than 5 mg KOH/g is used.

On the other hand, a polar resin with an excessively high acid value may bring the state of toner particle surfaces into disorder to cause a lowering of granulation performance. Hence, the polar resin should preferably have an acid value of from 5 to 100 mg KOH/g, and more preferably from 20 to 80 mg KOH/g. Even with the acid value in the range of from 20 to 80 mg KOH/g, a polar resin with an Mw/Mn more than 10 may be accompanied with a difficulty in its uniform dispersion in monomers, tending to make it difficult to obtain the toner having the intended particle size distribution. Of course, in the suspension polymerization toner used in the present invention, it is difficult to use a polar resin having so extremely large an Mw that it can not be uniformly dissolved in the monomers. The toner particle can not be made concave or made uneven also when the suspension polymerization is carried out using polar monomers in place of the polar resin. Polymerization carried out using a large quantity of such polar monomers rather tends to result in an extreme lowering of granulation performance. Hence, in order to obtain the toner having the uneven particle surfaces as described above, it is essential to use the polar resin having a high acid value.

The polymerization initiator used in the present invention may have a half-life period (hereinafter simply "t½") of from 0.5 hour to 30 hours, which may be added in an amount of from 0.5% to 20% by weight on the basis of the weight of the polymerizable monomers to carry out polymerization reaction, so that a polymer having a peak of molecular weight between 10,000 and 100,000 can be obtained and the desired strength and appropriate melt properties can be imparted to the toner. The polymerization initiator may include azo or diazo type polymerization initiators such as 2,2'-azobis-(2,4-dimethylvaleronitrile), 2,2'-azobisisobutyronitrile), 1,1'-azobis(cyclohexane-1-carbonitrile), 2,2'-azobis-4-methoxy-2,4-dimethylvaleronitrile and azobisisobutyronitrile, and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide.

In the present invention, a charge control agent may preferably have been added in the toner materials for the purpose of controlling the chargeability of the toner. Among known agents, charge control agents having neither polymerization inhibitory action nor aqueous-phase transfer properties should be used. For example, a positive charge control agent may include Nigrosine dyes, triphenylmethane dyes, quaternary ammonium salts, and amine type and polyamine type compounds. A negative charge control agent may include metal-containing salicylic acid compounds, metal-containing monoazo dyes, a styrene-acrylic acid copolymer, and a styrenemathacrylic acid copolymer.

As the colorant used in the present invention, known colorants can be used, including dyes such as carbon black, black iron oxide, C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Pigment Blue 15, C.I. Basic Blue 3, C.I. Basic Blue 5, C.I. Mordant Blue 7, C.I. Direct Green 6, C.I. Basic Green 4 and C.I. Basic Green 6, and pigments such as chrome yellow, cadmium yellow, mineral first yellow, navel yellow, Naphthol Yellow S, Hanza Yellow G, Permanent Yellow NCG, Tartrazine Lake, molybdenum orange, Permanent Orange GTR, Benzidine Orange G, cadmium red, C.I. Pigment Red 122, Permanent Red 4R, Watchung Red calcium salt, Brilliant Carmine 3B, Fast Violet B, Methyl Violet Lake, prussian blue, cobalt blue, Alkali Blue Lake, Victoria Blue Lake, quinacridone, Rhodamine Lake, Phthalocyanine Blue, Fast Sky Blue, Pigment Green B, Malachite Green Lake and Final Yellow Green G.

Since in the present invention the toner is obtained by polymerization, attention must be paid to the polymerization inhibitory action and aqueous-phase transfer properties inherent in the colorant. The colorant should more preferably be previously subjected to surface modification, for example, hydrophobic treatment using a material free from inhibition of polymerization. In particular, many of dyes and carbon black have the polymerization inhibitory action and hence attention must be paid when they are used. A preferable method for the surface treatment of the dyes may include a method in which polymerizable monomers are previously polymerized in the presence of any of these dyes. The resulting colorant polymer may be added to the monomer system. With regard to the carbon black, it is preferable, besides the same treatment on the dyes, to carry out grafting using a material capable of reacting with surface functional groups of the carbon black, as exemplified by polyorganosiloxane.

In the present invention, a magnetic material may be added to give a magnetic toner, which material also may preferably be used after it has been subjected to surface treatment.

The additives used in the present invention for the purpose of providing various properties may preferably have a particle diameter of not more than 1/10 of the weight average diameter of the toner particles. This particle diameter of the additives is meant to be an average particle diameter measured using an electron microscope by observing surfaces of toner particles. As these properties-providing additives, for example, the following can be used. 1) Fluidity-providing agents: Metal oxides as exemplified by silicon oxide, aluminum oxide and titanium oxide, carbon black, and carbon fluoride. These may more preferably have been subjected to hydrophobic treatment. 2) Abrasives: Metal compounds including metal oxides as exemplified by cerium oxide, aluminum oxide, magnesium oxide and chromium oxide, nitrides as exemplified by silicon nitride, carbides as exemplified by silicon carbide, and metal salts as exemplified by strontium titanate, calcium sulfate, barium sulfate and calcium carbonate. 3) Lubricants: Fluorine resin powders as exemplified by vinylidene fluoride and polytetrafluoroethylene, and fatty acid metal salts as exemplified by zinc stearate and calcium stearate. 4) Charge controlling particles: Metal oxides as exemplified by tin oxide, titanium oxide, zinc oxide, silicon oxide and aluminum oxide, and carbon black.

Any of these additives may be used in an amount of from 0.1 part to 10 parts by weight, and preferably from 0.1 part to 5 parts by weight, based on 100 parts by weight of the toner particles. These additives may be used alone or in combination of plural ones.

In the toner production process of the present invention, the toner composition described above, i.e., a monomer composition comprising polymerizable monomers, and appropriately added thereto the components necessary for the toner, such as a colorant, a release agent, a plasticizer, a binder, a charge control agent, a cross-linking agent and a magnetic material and other additives as exemplified by an organic solvent or dispersing agent added to decrease the viscosity of the polymer formed by polymerization reaction, which are uniformly dissolved or dispersed therein by means of a dispersion machine such as a homogenizer, a ball mill, a colloid mill or an ultrasonic dispersion machine, is suspended in the aqueous medium containing a dispersion stabilizer. At this time, it is more preferable to make the toner particles have the desired size in one step by the use of a high-speed stirrer or a high-speed dispersion machine such as an ultrasonic dispersion machine, since thereby the resulting toner particles can have a sharp particle diameter. The polymerization initiator may be added at the same time when other additives are added in the polymerizable monomers, or may be mixed right before the monomer composition is suspended in the aqueous medium. It is also possible to add polymerization initiator having been dissolved in the polymerizable monomers or a solvent, immediately after granulation and before the polymerization reaction is initiated.

After the granulation, stirring may be carried out using a conventional stirrer, to such an extent that the state of particles is maintained and the particles can be prevented from floating or settling.

In the suspension polymerization carried out in the present invention, any known surface active agent, organic dispersant or inorganic dispersant can be used as the dispersion stabilizer. Of these, the inorganic dispersant can be preferably used since it does not tend to bring about harmful ultrafine powder, does not tend to cause a loss of stability even when reaction temperatures are changed, because of its static hindrance action having provided the dispersion stability, enables washing with ease and does not tend to adversely affect tile toner. Examples of such an inorganic dispersion stabilizer, include phosphoric acid polyvalent metal salts such as calcium phosphate, magnesium phosphate, aluminum phosphate and zinc phosphate; carbonates such as calcium carbonate and magnesium carbonate; inorganic salts such as calcium metasilicate, calcium sulfate and barium sulfate; inorganic hydroxides such as calcium hydroxide, magnesium hydroxide and aluminum hydroxide; and inorganic oxides such as silica, bentonite and alumina.

Any of these inorganic dispersant may preferably be used alone in an amount of from 0.2 part to 20 parts by weight based on 100 parts by weight of the polymerizable monomers. Such use does not tend to bring about ultrafine particles, but may be a little disadvantageous for obtaining fine toner particles. Hence, it may also be used in combination with from 0.001 to 0.1 part by weight of a surface active agent.

The surface active agent may include, for example, sodium dodecylbenzenesulfate, sodium tetradecylsulfate, sodium pentadecylsulfate, sodium octylsulfate, sodium oleate, sodium laurate, sodium stearate and potassium stearate.

When the inorganic dispersants are used, they may each be used as they are. In order to obtain finer particles, particles of the inorganic dispersant may be formed in the aqueous medium. For example, in the case of calcium phosphate, an aqueous sodium phosphate solution and an aqueous calcium chloride solution may be mixed with high-speed stirring, whereby water-insoluble calcium phosphate can be formed and more uniform and finer dispersion can be carried out.

Use of this method enables formation of a very fine salt to give a stable state of suspension, bringing about a good granulation performance. With regard to toner particle configuration, preferable size and number of concavities on the surface can be brought about. Moreover, since oil droplets are stable, the phase separation into the phase-A and phase-B can be promoted to give a preferable particle structure of the toner.

At this time, water-soluble sodium chloride is simultaneously formed as a by-product. Presence of such a water-soluble salt in the aqueous medium, however, is rather favorable since it prohibits water from dissolving in the polymerizable monomers to make ultrafine toner not tend to be formed by emulsion polymerization. It can be an obstacle when the remaining polymerizable monomers are removed at the termination of polymerization reaction, and hence it is better to change the aqueous medium or carry out desalting using an ion-exchange resin. The inorganic dispersant can be almost completely removed by dissolving it with an acid or alkali after the polymerization has been completed.

In the aforesaid step of polymerization, the polymerization may be carried out at a polymerization temperature set at 40° C. or above, usually from 50° to 90° C. Polymerization carried out within this temperature range allows the release agent, wax and so forth that should be enclosed in the inside, to precipitate by phase separation, so that they can be internally held more completely. In order to consume the remaining polymerizable monomers, it is possible to raise the reaction temperature up to 90° to 150° C. if the polymerization reaction is at the termination.

Under conditions as described above, the conversion almost linearly increases up to a polymerization conversion of less than 90%. At a polymerization conversion of 90% or more where the toner becomes solid, the degree of polymerization slowly increases, and at a polymerization conversion of 95% or more it very slowly increases. The polymerizable monomers remaining in the toner are in a final quantity of not more than 1,000 ppm.

The means for controlling to not more than 1,000 ppm the organic solvent, polymerizable monomers or a mixture of these contained in the toner particles used in the present invention may include (i) a method in which the polymerization reaction is continued as previously described, until the organic solvent, polymerizable monomers or a mixture of these becomes not more than 1,000 ppm in the toner particles; (ii) a method in which the consumption of polymerizable monomers is accelerated at the moment the polymerization conversion has reached 95% or more; and (iii) a method in which the organic solvent, polymerizable monomers or a mixture of these is removed from toner particles without transporting the low softening point material-B at the core to the phase-A at the surface portion is used.

The method (ii) of accelerating the consumption of polymerizable monomers can be exemplified by (a) a method in which polymerization reaction temperature is raised by 5° to 60° C., preferably 10° to 50° C., and more preferably 20° to 40° C., at the moment the polymerization conversion has reached 95% or more, preferably using in combination a polymerization initiator capable of being decomposed at high temperatures; (b) a method in which a polymerization initiator with a long half-life period and a polymerization initiator with a short half-life period are used in combination; and (c) a method in which a polyfunctional polymerization initiator having a plurality of polymerization initiating points is used.

The method (iii) of removing the organic solvent, polymerizable monomers or a mixture of these from the toner particles can be exemplified by a method (d) in which the reflux is stopped after completion of the polymerization reaction or at the latter-half stage of the polymerization reaction, or the unreacted polymerizable monomers and/or organic solvent is/are partly removed under normal pressure or reduced pressure; and (e) a method in which toner particles are subjected to deaeration at a low temperature and under reduced pressure.

In the present invention, the organic solvent, polymerizable monomers or a mixture of these contained in the toner particles is controlled to be finally in a quantity of not more than 1,000 ppm, and preferably in a quantity of not more than 100 ppm in order to eliminate any bad smell that may be given out during fixing, originating from the polymerizable monomers and reaction residues thereof or the solvent.

The polymerization conversion is measured using a sample prepared by adding a polymerization inhibitor to 1 g of a suspension and dissolving the suspension in 4 ml of THF (tetrahydrofuran), and the quantity of remaining polymerizable monomers and the quantity of remaining organic solvent are determined using a sample prepared by dissolving 0.2 g of toner in 4 ml of THF. These are measured or determined by gas chromatography (GC) under the following conditions according to the internal standard method.

Measuring apparatus:
Shimadzu GC-15A (with capillaries)
Carrier: $N_2$, 2kg/cm$^2$ 50 ml/min.
Split 10 ml/13s
Columns: ULBON HR-1 50 m × 0.25 mm in diam.
Temperature rise:
50° C., maintained for 5 min.
↓ 10° C./min.
100° C.
↓ 20° C./min.
200° C., maintained.
Amount of sample:
2 μl
Marking substance: Toluene In the present invention the particle size distribution is measured in the manner as described below.

Coulter counter Type TA-II (manufactured by Coulter Electronics, Inc.) is used as a measuring device. An interface (manufactured by Nikkaki k.k.) that outputs number average distribution and volume average distribution and a personal computer CX-1 (manufactured by Canon Inc.) are connected. As an electrolytic solution, an aqueous 1% NaCl solution is prepared using first-grade sodium chloride.

Measurement is carried out by adding as a dispersant from 0.1 to 5 ml of a surface active agent, preferably an alkylbenzene sulfonate, to from 100 to 150 ml of the above aqueous electrolytic solution, and further adding from 0.5 to 50 mg of a sample to be measured.

The electrolytic solution in which the sample has been suspended is subjected to dispersion for about 1 minute to about 3 minutes using an ultrasonic dispersion device. The particle size distribution of particles of 2 μm to 40 μm is measured by means of the above Coulter counter Type TA-II, using an aperture of 100μ as its aperture. Then the volume average distribution and number average distribution are determined.

Weight average particle diameter D4 is obtained from these volume average distribution and number average distribution thus determined.

The molecular weight in the present invention is measured by the method described below.

(1) Preparation of Sample i) Standard Sample

Commercially available standard polystyrenes shown below are used as standard samples.

| Molecular weight | Manufacturer |
|---|---|
| $8.42 \times 10^6$ | Toyo Soda Manufacturing Co., Ltd. |
| $2.7 \times 10^6$ | Waters Co. |
| $1.2 \times 10^6$ | Waters Co. |
| $7.75 \times 10^5$ | Toyo Soda Manufacturing Co., Ltd. |
| $4.7 \times 10^5$ | Waters Co. |
| $2.0 \times 10^5$ | Waters Co. |

-continued

| Molecular weight | Manufacturer |
|---|---|
| $3.5 \times 10^4$ | Waters Co. |
| $1.5 \times 10^4$ | Waters Co |
| $1.02 \times 10^4$ | Toyo Soda Manufacturing Co., Ltd. |
| $3.6 \times 10^3$ | Waters Co. |
| $2.35 \times 10^3$ | Waters Co. |
| $5.0 \times 10^2$ | Toyo Soda Manufacturing Co., Ltd. |

These twelve standard polystyrenes are divided into the following three groups.

(a) $8.42\times10^6$, $7.75\times10^5$, $3.5\times10^4$, $3.6\times10^3$ (b) $2.7\times10^6$, $4.7\times10^5$, $1.5\times10^4$, $2.35\times10^3$ (c) $1.2\times10^6$, $2.0\times10^5$, $1.02\times10^4$, $5.0\times10^2$ In a 30 ml sample bottle, four samples of each group are taken in an amount of about 3 mg (a quantity corresponding to a micro-spatula) for each, and 15 ml of THF is added thereto, which are then left to stand at room temperature for 4 hours (during which the bottle is vigorously shaken for 1 minute at intervals of 30 minutes). Subsequently, its contents are filtered using a membrane filter (regenerated cellulose, 0.45 μm; available from Toyo Roshi). Standard sample are thus prepared.

ii) Unknown

Each sample weighed in an amount of 60 mg is put in a sample bottle, and 15 ml of THF is further added. Extraction is carried out in the following way: The bottle is left to stand at room temperature for 24 hours while it is shaken at intervals of 30 minutes for the first 3 hours. Ultrasonic treatment is further applied for 15 minutes to sufficiently effect extraction. Insoluble matters are sedimented by centrifugal separation (5,000 rpm/20 min.). The resulting supernatant is filtered using a membrane filter (regenerated cellulose, 0.45 μm; available from Toyo Roshi). Sample are thus prepared.

(2) GPC:

Using 150C ALC/GPC (Waters Co.) as an apparatus, measured under the following conditions.

i) Solvent: THF (special grade; Kishida Chemical Co., Ltd.)

ii) Column: Combination of 4 columns, Showdex A-802, A-803, A-804, A-805 (Showa Denko K.K.)

iii) Temperature: 28° C.

iv) Flow velocity: 1.0 ml/min.

v) Pour: 0.5 ml vi) Detector: RI (3) GPC Data Processing i) Calibration Curve (a) Chromatograms of each standard sample are taken, and the retention time of a peak is read. In instances in which several peaks are present, the time of the main peak is read.

(b) A calibration curve is prepared from the molecular weight of each standard sample and the peak retention time.

ii) Unknown

Chromatograms of each unknown sample are taken, and its molecular weight is calculated from the peak retention time, using the calibration curve.

The melting point of the low softening point material such as wax in the present invention is measured using a differential scanning calorimeter DSC-7 (manufactured by Perkin-Elmer Co.), at a rate of temperature rise of 10° C./min. In the DSC curve of the first temperature rise, the peak temperature corresponding to a maximum endothermic peak is regarded as the melting point of the wax.

The toner of the present invention comprises toner particles each having the structure separated into the phase-A mainly composed of the high softening point resin-A and the phase-B mainly composed of the low softening point material-B, said phase-B being absent in the vicinity of the toner particle surface, ranging from its surface to a depth 0.15 time a toner particle diameter; and containing the organic solvent, polymerizable monomers or a mixture thereof in a quantity of not more than 1,000 ppm. Hence, it can enjoy superior low-temperature fixing Performance and release properties and a superior blocking resistance. It also stably shows a high developing performance, and can be free from, or less undergo, changes in performances in its long-term use.

EXAMPLES

The present invention will be specifically described below by giving Examples. In the following formulation, "part(s)" refers to "part(s) by weight" in all occurrences.

EXAMPLE 1

An aqueous 0.1 M $Na_3PO_4$ solution and an aqueous 1 M $CaCl_2$ solution were prepared. Into a TK-type homomixer (manufactured by Tokushu Kika Kogyo Co., Ltd.), 451 g of aqueous 0.1 M $Na_3PO_4$ solution and 709 g of ion-exchanged water were introduced, and the mixture was stirred at 12,000 rpm. Then, 67.7 g of aqueous 1 M $CaCl_2$ solution was added little by little with stirring using the above homomixer heated to 70° C., to give a dispersion medium containing $Ca_3(PO_4)_2$.

| | |
|---|---|
| Styrene | 170 g |
| 2-Ethylhexyl acrylate | 30 g |
| C.I. Pigment Blue 15:3 | 10 g |
| Styrene-methacrylic acid-methyl methacrylate copolymer (Mw: 50,000; Mw/Mn: 2.5; acid value: 50 mg KOH/g) | 5 g |
| Paraffin wax (m.p.: 70° C.) | 60 g |
| Di-tert-butylsalicylic acid metal compound | 3 g |

Of the above materials, only the C.I. Pigment Blue 15:3, di-tert-butylsalicylic acid metal compound and styrene were premixed using Ebara Milder (manufactured by Ebara Corp.). Next, all the materials were heated to 60° C., and dissolved and dispersed to give a monomer mixture. While maintaining the mixture at 60° C., 10 g of 2,2'-azobis(2,4-dimethylvaleronitrile) [$t_{\frac{1}{2}}$: 140 min. at 60° C.] and 1 g of dimethyl 2,2'-azobisisobutyrate [$t_{\frac{1}{2}}$: 1,270 min. at 60° C., $t_{\frac{1}{2}}$: 80 min. at 80° C.] as polymerization initiators were dissolved therein. A monomer composition was thus prepared. The monomer composition thus obtained was introduced into the above dispersion medium, followed by stirring at 10,000 rpm for 20 minutes at 60° C. using the TK homomixer in an atmosphere of $N_2$, to carry out granulation of the monomer composition to form suspension droplets of toner particle size. Thereafter, while stirring with paddle stirring blades, the reaction was carried out at 60° C. for 3 hours. At this stage, the polymerization conversion was 90%. Thereafter, the flux of water vapor was stopped and then the temperature was raised to 80° C. to carry out stirring for further 10 hours. After the reaction was completed, the suspension was cooled, and hydrochloric acid was added to dissolve the $Ca_3(PO_4)_2$, followed by filtration, washing with water and drying to give toner particles with a weight average particle diameter of 8.2 μm. At this stage, the remaining polymerizable monomers were in a quantity of 100 ppm. The resulting toner particles were subjected to deaeration at 45° C. under reduced pressure of 50 mmHg for 12 hours. At this stage, the remaining polymerizable monomers were in a quantity of 90 ppm.

Observation using an electron microscope confirmed that toner particles had surfaces with concave undulations, having been made uneven (R/r: 1.07; L/l: 1.15.). Cross sections of the toner particles were also observed on a transmission electron microscope by the dyed ultra-thin sections method. As a result, it was confirmed that the particles were each structurally separated into the surface layer mainly composed of styrene-acrylic resin and the core mainly composed of wax and that the phase mainly composed of wax was absent in the vicinity of each toner particle surface, ranging from its surface to a depth 0.15 time a toner particle diameter.

Based on 100 parts by weight of the toner particles thus obtained, 0.7 part of hydrophobic silica having a BET surface specific area of 200 $m^2/g$ was externally added to give a toner. Based on parts of this toner, 93 parts of an acryl-coated ferrite carrier was blended with the toner to give a developer.

Using this developer, unfixed images were obtained using a full-color copying machine CLC-500, manufactured by Canon Inc. The toner on paper was controlled to be in a quantity of $0.75 \pm 0.05$ $mg/cm^2$, and a fixing test was made using an external fixing test machine. Here, the fixing roller used was made of a material comprising silicone rubber (HTV) coated with PFA resin in a thickness of 30 μm, and having a hardness of 55°.The images were fixed at a process speed of 90 mm/sec and the temperature was changed at intervals of 5° C. within the temperature range of from 100° to 220° C. to carry out the fixing test.

As a result, the fixing temperature was in the range of from 155° C. to 190° C., and a release effect attributable to the wax was exhibited.

The above toner particles were also left to stand in a 50° C. dryer for 10 days to carry out a blocking test in the following way. As a result, the blocking resistance was evaluated as "A". Blocking test:

5 g of the sample having been left in the drier was taken in a powder tester manufactured by Hosokawa Micron Corporation provided with a 60 mesh sieve, followed by shaking for 20 seconds under conditions of DC 1.8 V. The quantity of the toner remaining on the sieve was measured to make evaluation of blocking resistance according to the following evaluation criterions.

| Quantity of toner remaining on 60 mesh sieve (g) | Blocking resistance, evaluated as: |
|---|---|
| 0 to less than 1 | A |
| 1 to less than 4 | B |
| 4 to 5 | C |

Next, using the copying machine CLC-500, a 20,000 sheet running test was carried out to obtain the results that the image density was 1.4 or higher, no fogging occurred, images with a very high resolution were obtained, no faulty cleaning occurred, and no toner scatter in the copying machine was conspicuous.

EXAMPLE 2

Example 1 was repeated except that no polar resin was used, to give cyan toner particles with a weight average particle diameter of 8.3 μm (remaining polymerizable monomer content: 230 ppm).

Blocking resistance of the toner particles thus obtained was tested in the same manner as in Example 1, and was evaluated as "A".

A developer was prepared in the same manner and images were reproduced. As a result, compared with the toner of Example 1, the image density tended to decrease with the progress of running, and a slight faulty cleaning was seen after copies had been taken on about 3,000 sheets. The toner at the initial stage of the running test was observed with FE-SEM to reveal that the toner particles had no uneven surfaces and were truely spherical.

Cross sections of the toner particles were also observed on a transmission electron microscope by the dyed ultra-thin sections method. As a result, it was confirmed that the toner particles were each structurally separated into the surface layer mainly composed of styrene-acrylic resin and the core mainly composed of wax and that the phase mainly composed of wax was absent in the vicinity of each toner particle surface, ranging from its surface to a depth 0.15 time a toner particle diameter.

Comparative Example 1

In Example 1, the same state was maintained 3 hours after completion of the reaction. After 8 hours in total, at the moment the polymerization conversion reached 99% or more, the toner particles were taken out, followed by washing of the dispersant, and drying. At this stage, the remaining polymerizable monomers were in a quantity of 7,000 ppm. Blocking resistance of the toner particles thus obtained was tested in the same manner as in Example 1, and was evaluated as "C". Using this toner particles, a developer was prepared and images were reproduced in the same manner as in Example 1. As a result, images as good as those in Example 1 were obtained. However, there was a styrene smell from around the fixing apparatus. This toner particles were left to stand in an environment of 35° C. for a month. As a result, the quantity of triboelectricity of the toner greatly decreased to give images with very much fogging.

EXAMPLE 3

Example 1 was repeated except that the polar resin used therein was replaced with a styrene-butyl acrylate copolymer having Mw of 30,000, Mw/Mn of 3.8 and an acid value of 0.2 mg KOH/g. Thus, cyan toner particles with a weight average particle diameter of 8.6 μm were obtained (remaining polymerizable monomer content: 210 ppm).

Blocking resistance of the toner particles thus obtained was tested in the same manner as in Example 1, and was evaluated as "A".

The toner particles obtained had a resonably broad particle size distribution. Besides, they had no uneven surface, and were truly spherical. Cross sections of the toner particles were also observed on a transmission electron microscope by the dyed ultra-thin sections method. As a result, it was confirmed that the toner particles were each structurally separated into the surface layer mainly composed of styrene-acrylic resin and the core mainly composed of wax and that the phase mainly composed of wax was absent in the vicinity of each toner particle surface, ranging from its surface to a depth 0.15 time a toner particle diameter.

A developer was prepared and images were reproduced in the same manner as in Example 1. As a result, compared with the toner of Example 1, the image density tended to decrease with the progress of running, and a slight faulty cleaning was seen after copies had been taken on about 3,000 sheets.

EXAMPLE 4

Example 1 was repeated to give toner particles except that the amount of wax was decreased to 20 g (10 parts). The polymerizable monomers remaining in the toner particles thus obtained were in an quantity of 60 ppm.

Blocking resistance of the toner particles obtained was tested in the same manner as in Example 1, and was evaluated as "A".

Observation using an electron microscope confirmed that toner particles had surfaces with concaved undurations, having been made uneven (R/r: 1.06; L/l: 1.13.). Cross sections of the toner particles were also observed on a transmission electron microscope by the dyed ultra-thin sections method. As a result, it was confirmed that the particles were each structurally separated into the surface layer mainly composed of styrene-acrylic resin and the core mainly composed of wax and that the phase mainly composed of wax was absent in the vicinity of each toner particle surface, ranging from its surface to a depth 0.15 time a toner particle diameter.

Using this developer, a developer was prepared in the same manner as in Example 1, and a fixing test was made similarly. As a result, the fixing temperature was in the range of from 160° C. to 170° C. Thus the fixing temperature range was a little narrower than that of the toner of Example 1.

EXAMPLE 5

Example 1 was repeated except that the polar resin used therein was replaced with a styrene-methacrylic acid-methyl methacrylate copolymer having Mw of 10,000, Mw/Mn of 3.5 and an acid value of 70 mg KOH/g. Thus, cyan toner particles with a weight average particle diameter of 8.0 μm were obtained.

The polymerizable monomers remaining in the toner particles thus obtained were in an quantity of 180 ppm.

Blocking resistance of the toner particles obtained was tested in the same manner as in Example 1, and was evaluated as "A".

Observation using an electron microscope confirmed that tonex particles had surfaces with concaved undurations, having been made uneven (R/r: 1.08; L/l: 1.08.). Cross sections of the toner particles were also observed on a transmission electron microscope by the dyed ultra-thin sections method. As a result, it was confirmed that the particles were each structurally separated into the surface layer mainly composed of styrene-acrylic resin and the core mainly composed of wax and that the phase mainly composed of wax was absent in the vicinity of each toner particle surface, ranging from its surface to a depth 0.15 time a toner particle diameter.

A developer was prepared in the same manner as in Example 1, and a 10,000 sheet running test was made. As a result, always stable images with less variations of image density were obtained and no faulty cleaning was seen at all. The toner after the running was observed with FE-SEM to confirm that the toner particles had substantially the same uneven surfaces as the toner particles before the running and also that silica had been deposited on the surfaces.

EXAMPLE 6

Example 1 was substantially repeated except that the polar resin used therein was replaced with a styrene-methacrylic acid-methyl methacrylate copolymer having Mw of 58,000, Mw/Mn of 3.0 and an acid value of 63 mg KOH/g, the amount of the paraffin wax was changed to 50 g and the pigment used was replaced with 10 g of C.I. Pigment Red 122. Thus, magenta toner particles with a weight average particle diameter of 7.9 μm were obtained (R/r: 1.03; L/l: 1.05.).

In the production of the toner particles, the polymerization reaction was carried out at 60° C. for 4 hours, and thereafter distillation was carried out under reduced pressure at a degree of vacuum (absolute pressure) of 188 Tort at 65° C. for 5 hours to evaporate unreacted polymerizable monomers. The subsequent procedure of Example 1 was repeated to carry out drying. In the toner particles finally obtained, the remaining polymerizable monomers were in a quantity of 45 ppm.

Blocking resistance of the toner particles obtained was tested in the same manner as in Example 1, and was evaluated as "A".

Observation using an electron microscope confirmed that toner particles had surfaces with concaved undurations, having been made uneven (R/r: 1.03; L/l: 1.05.). Cross sections of the toner particles were also observed on a transmission electron microscope by the dyed ultra-thin sections method. As a result, it was confirmed that the particles were each structurally separated into the surface layer mainly composed of styrene-acrylic resin and the core mainly composed of wax and that the phase mainly composed of wax was absent in the vicinity of each toner particle surface, ranging from its surface to a depth 0.15 time e toner particle diameter.

Using the toner particles obtained, a developer was prepared and images were reproduced in the same manner as in Example 1. As a result, the same good images as in Example 1 were obtained.

The quantity of triboelectricity of the developer immediately after its preparation was −28.0 μc/g. Compared therewith, the quantity of triboelectricity of the toner having been left in an environment of 35° C. for a month was as very stable as −26.8 μc/g. Thus the toner was clearly seen to have superior storage stability, blocking resistance and charge stability.

Comparative Example 2

In Example 1, the same state was maintained 3 hours after completion of the reaction. After 8 hours in total, at the moment the polymerization conversion reached 99% or more, the flux of water vapor was stopped and then the temperature was raised to 95° C., which was maintained for 3 hours. Thereafter, the toner particles were taken out, followed by washing of the dispersant, and drying. At this stage, the remaining polymerizable monomers contained in the resulting toner particles were in a quantity of 500 ppm.

The state of surfaces of the toner particles obtained was observed using a transmission electron microscope to reveal that wax components were present on the surfaces. Blocking resistance tested in the same manner as in Example 1 was evaluated as "C".

We claim:

1. A toner for developing an electrostatic image comprising toner particles:

said toner particles being prepared by suspension polymerization of a monomer component containing at least a polymerizable monomer in an aqueous medium;

containing at least two components comprised of a high softening point resin-A and a low softening point material-B;

each having a structure separated into a phase-A mainly composed of said resin-A and a phase-B mainly composed of said material-B, said phase-B being absent from the vicinity of the toner particle surface, said vicinity ranging from the toner particle surface to a depth 0.15 time a toner particle diameter; and wherein an organic solvent, said polymerizable monomer or a mixture thereof is present in a quantity of not more than 1,000 ppm.

2. The toner according to claim 1, wherein said high softening point resin-A has a weight average molecular weight of from 5,000 to 200,000.

3. The toner according to claim 1, wherein said high softening point resin-A has a flow-out point of from 65° C. to 100° C.

4. The toner according to claim 1, wherein said high softening point resin-A comprises a polymer or copolymer obtained from a polymerizable monomer selected from the group consisting of a styrene monomer, an acrylate, a methacrylate, an acrylonitrile, a methacrylonitrile and an acrylamide.

5. The toner according to claim 1, wherein said low softening point material-B has a weight average molecular weight of from 300 to 10,000.

6. The toner according to claim 1, wherein said low softening point material-B has a melting point of from 30° C. to 130° C.

7. The toner according to claim 1, wherein said low softening point material-B has a melting point of from 60° C. to 100° C.

8. The toner according to claim 1, wherein said high softening point resin-A and said low softening point material-B in said toner are in a component ratio A:B of from 50:50 to 95:5.

9. The toner according to claim 1, wherein said high softening point resin-A and said low softening point material-B in said toner are in a component ratio A:B of from 70:30 to 90:10.

10. The toner according to claim 1, wherein with respect to a projected area of a toner particle of said toner particles, its maximum inscribed circle corresponding to its radius r and minimum circumscribed circle corresponding to its radius R satisfies the following relationship (1):

$$1.00 < R/r \leqq 1.20 \quad (1)$$

and said toner particles each have an uneven surface such that circumferential length L and circumference l of the inscribed circle of a projected area of the toner particle satisfies the following relationship (2):

$$1.01 < L/l < 2.00. \quad (2)$$

11. The toner according to claim 1, wherein said toner particles contain a polar resin.

12. The toner according to claim 11, wherein said polar resin comprises a cationic polymer or an anionic polymer.

13. The toner according to claim 11, wherein said polar resin has a ratio of weight average molecular weight to number average molecular weight Mw/Mn of from 1.2 to 10.

14. The toner according to claim 11, wherein said polar resin has a ratio of weight average molecular weight to number average molecular weight Mw/Mn of from 1.5 to 5.

15. The toner according to claim 11, wherein said polar resin has an acid value of from 5 to 100 mg KOH/g.

16. The toner according to claim 11, wherein said polar resin has an acid value of from 20 to 80 mg KOH/g.

17. The toner according to claim 1, wherein said toner particles have a weight average particle diameter of from 2 μm to 20 μm.

18. The toner according to claim 1, wherein said toner particles have a weight average particle diameter of from 3 μm to 12 μm.

19. The toner according to claim 1, wherein said toner contains an additive selected from the group consisting of a fluidity-providing agent, an abrasive, a lubricant and charge controlling particles.

20. The toner according to claim 19, wherein said additive has a weight average particle diameter of not more than 1/10 of the weight average particle diameter of the toner particles.

21. The toner according to claim 1, wherein said toner particles are obtained by subjecting a monomer composition containing i) a polymerizable monomer that forms said high softening point resin-A and ii) said low softening point material, to suspension polymerization in an aqueous dispersion medium containing a dispersion stabilizer.

22. The toner according to claim 1, wherein said dispersion stabilizer contains an inorganic dispersant selected from the group consisting of a phosphoric acid polyvalent metal salt, a carbonate, an inorganic salt and an inorganic oxide.

23. The toner according to claim 21, wherein said dispersion stabilizer contains a surface active agent selected from the group consisting of sodium dodecylbenzenesulfate, sodium tetradecylsulfate, sodium pentadecylsulfate, sodium octylsulfate, sodium oleate, sodium laurate, sodium stearate and potassium stearate.

24. The toner according to claim 1, wherein said toner particles are obtained by suspension polymerization comprising granulating and polymerizing a monomer composition containing i) a polymerizable monomer that forms said high softening point resin-A and ii) said low softening point material, in an aqueous dispersion medium, and continuing the polymerization reaction until said organic solvent, polymerizable monomer or a mixture thereof comes to be contained in a quantity of not more than 1,000 ppm.

25. The toner according to claim 1, wherein said toner particles are obtained by suspension polymerization comprising granulating and polymerizing a monomer composition containing i) a polymerizable monomer that forms said high softening point resin-A and ii) said low softening point material, in an aqueous dispersion medium, and accelerating the consumption of polymerizable monomers at the moment the polymerization conversion has reached 95% or more.

26. The toner according to claim 25, wherein said toner particles are obtained by suspension polymerization comprising accelerating the consumption of polymerizable monomers by raising polymerization temperature by 5° C. to 60° C. at the moment the polymerization conversion has reached 95% or more.

27. The toner according to claim 26, wherein said toner particles are obtained by suspension polymerization using in combination a polymerization initiator capable of being decomposed at a polymerization temperature by which the polymerization conversion has reached 95% or more and a polymerization initiator capable of being decomposed at a polymerization temperature 5° C. to 60° C. higher than the first-mentioned polymerization temperature.

28. The toner according to claim 25, wherein said toner particles are obtained by suspension polymerization comprising accelerating the consumption of polymerizable monomers by using in combination a polymerization initiator having a long half-life period and a polymerization initiator having a short half-life period, at the moment the polymerization conversion has reached 95% or more.

29. The toner according to claim 25, wherein said toner particles are obtained by suspension polymerization comprising accelerating the consumption of polymerizable monomers by using a polyfunctional polymerization initiator having a plurality of polymerization initiating points, at the moment the polymerization conversion has reached 95% or more.

30. The toner according to claim 1, wherein said toner particles are obtained by subjecting toner particles obtained by suspension polymerization comprising granulating and polymerizing a monomer composition containing i) a polymerizable monomer that forms said high softening point resin and it) said low softening point material, in an aqueous dispersion medium, to a treatment to remove from said toner particles the organic solvent, polymerizable monomers or a mixture of these without transporting the phase-B low softening point material-B to the surfaces of the toner particles.

31. The toner according to claim 30, wherein said toner particles are obtained by carrying out a treatment to remove from the toner particles the organic solvent, polymerizable monomers or a mixture of these after completion of the polymerization reaction or at the latter-half stage of the polymerization reaction, in an aqueous medium under normal pressure or reduced pressure.

32. The toner according to claim 30, wherein said toner particles are obtained by subjecting the toner particles obtained by said suspension polymerization, to deaeration at a low temperature and under reduced pressure.

* * * * *

UNITED STATES PATENT AND TRADEMARK OFFICE

CERTIFICATE OF CORRECTION

PATENT NO. : 5,354,640

DATED : October 11, 1994

INVENTOR(S) : MAKOTO KANBAYASHI, ET AL.

It is certified that error appears in the above-identified patent and that said Letters Patent is hereby corrected as shown below:

ON TITLE PAGE

In [56] References Cited, under FOREIGN PATENT DOCUMENTS:
"153786 11/1989 Japan ." should read
--1-53786 11/1989 Japan .--.

COLUMN 1

Line 21, "method," should read --methods,--.
Line 30, "prevaling" should read --prevailing--.
Line 38, "high-safety." should read --high safety.--

COLUMN 2

Line 3, "Giving" should read --giving--.

COLUMN 3

Line 3, "cake," should read --cake, even--.
Line 10, "good-quality" should read --good quality--.
Line 35, "tends" should read --by--.
Line 62, "comprising;" should read --comprising:--.

COLUMN 5

Line 42, "Good" should read --good--.
Line 43, "uneveness" should read --unevenness--.

COLUMN 6

Line 45, "in" should read --have--.
Line 66, "et" should read --a--.

UNITED STATES PATENT AND TRADEMARK OFFICE

CERTIFICATE OF CORRECTION

PATENT NO. : 5,354,640

DATED : October 11, 1994

INVENTOR(S) : MAKOTO KANBAYASHI, ET AL.

It is certified that error appears in the above-identified patent and that said Letters Patent is hereby corrected as shown below:

COLUMN 7

Line 64, "include;" should read --include:--.

COLUMN 8

Line 23, "ill" should read --in--.
Line 48, "concave" should read --concave,--.

COLUMN 9

Line 19, "2,2'-azobisisobutyronitrile)," should read --2,2'-azobisisobutyronitrile,--.
Line 33, "Nigrosine" should read --nigrosine--.
Line 38, "styrenemathacrylic" should read --styrene-methacrylic--.
Line 48, "navel" should read --naval--.
Line 49, "Hanza" should read --Hansa--.

COLUMN 11

Line 15, "static" should read --steric--.
Line 17, "tile" should read --the--.
Line 19, "lizer," should read --lizer--.
Line 28, "dispersant" should read --dispersants--.

COLUMN 13

Line 14, insert: --GC conditions--.

COLUMN 14

Line 23, "sample" should read --samples--.
Line 36, "Sample" should read --Samples--.

UNITED STATES PATENT AND TRADEMARK OFFICE

CERTIFICATE OF CORRECTION

PATENT NO. : 5,354,640

DATED : October 11, 1994

INVENTOR(S) : MAKOTO KANBAYASHI, ET AL.

It is certified that error appears in the above-identified patent and that said Letters Patent is hereby corrected as shown below:

COLUMN 15

Line 13, "Performance" should read --performance--.

COLUMN 16

Line 24, "parts" should read --7 parts--.
Line 45, ""A". Blocking" should read --"A". ¶ Blocking--.
Line 53, "criteri-" should read --criteria--.
Line 54, "ons." should be deleted.

COLUMN 17

Line 18, "truely" should read --truly--.
Line 39, "this" should read --these--.
Line 44, "This" should read --These--.

COLUMN 18

Line 16, "an" should read --a--.
Line 21, "concaved undura-" should read --concave undula- --.
Line 32, "developer," should read --toner,--.
Line 47, "an" should read --a--.
Line 52, "tonex" should read --toner-- and
"concaved undura-" should read --concave undula- --.

COLUMN 19

Line 19, "188 Tort" should read --188 Torr--.
Line 28, "concaved undura-" should read --concave undula- --.
Line 29, "L/I: 1.05.)." should read --L/l: 1.05.).--.
Line 38, "e" should read --a--.

UNITED STATES PATENT AND TRADEMARK OFFICE

CERTIFICATE OF CORRECTION

PATENT NO. : 5,354,640

DATED : October 11, 1994

INVENTOR(S) : MAKOTO KANBAYASHI, ET AL.

It is certified that error appears in the above-identified patent and that said Letters Patent is hereby corrected as shown below:

COLUMN 20

Line 2, "particles:" should read --particles;--.

COLUMN 21

Line 36, "material," should read --material-B,--.
Line 55, "material," should read --material-B,--.

COLUMN 22

Line 3, "material," should read --material-B,--.
Line 42, "resin" should read --resin-A-- and "it)" should read --ii)--.

Signed and Sealed this

Twenty-eight Day of March, 1995

Bruce Lehman

*Attest:*

BRUCE LEHMAN

*Attesting Officer*

*Commissioner of Patents and Trademarks*